US011155951B2

(12) United States Patent
Li et al.

(10) Patent No.: US 11,155,951 B2
(45) Date of Patent: Oct. 26, 2021

(54) LAUNDRY WASHING MACHINE FOR USE WITH UNIT DOSE DETERGENT PACKAGES

(71) Applicant: Electrolux Appliances Aktiebolag, Stockholm (SE)

(72) Inventors: Yihong Li, Charlotte, NC (US); Anthony Lufkin, Charlotte, NC (US); Allison White, Charlotte, NC (US); Terry Anderson, Charlotte, NC (US)

(73) Assignee: Electrolux Appliances Aktiebolag

( * ) Notice: Subject to any disclaimer, the term of this patent is extended or adjusted under 35 U.S.C. 154(b) by 27 days.

(21) Appl. No.: 16/522,156

(22) Filed: Jul. 25, 2019

(65) Prior Publication Data

US 2021/0025103 A1 Jan. 28, 2021

(51) Int. Cl.
*D06F 39/02* (2006.01)
*D06F 37/12* (2006.01)
(Continued)

(52) U.S. Cl.
CPC ..... *D06F 39/024* (2013.01); *D06F 37/12* (2013.01); *D06F 37/36* (2013.01); *D06F 37/40* (2013.01);
(Continued)

(58) Field of Classification Search
CPC ..... D06F 39/024; D06F 37/12; D06F 37/36; D06F 37/40; D06F 39/088; D06F 33/37;
(Continued)

(56) References Cited

U.S. PATENT DOCUMENTS 2,821,848 A 2/1958 Becker
2,933,912 A * 4/1960 Billings ..... D06F 39/024 68/17 A
(Continued)

FOREIGN PATENT DOCUMENTS

BR 202014023113 Y1 12/2019
DE 19537671 A1 4/1997
(Continued)

OTHER PUBLICATIONS

International Search Report and Written Opinion for International Application No. PCT/EP2014/079129, dated Mar. 23, 2015, 11 pages.
(Continued)

*Primary Examiner* — Michael E Barr
*Assistant Examiner* — Pallavi Chitta
(74) *Attorney, Agent, or Firm* — RatnerPrestia

(57) ABSTRACT

A method and apparatus for breaking a unit dose package in a chamber within a post located in a basket of a laundry washing machine. The method includes filling the basket and the chamber, increasing a rotation speed of the basket and/or the post to raise the water level in the basket and lower the water level in the chamber to cause a unit dose package within the chamber to move downwards; reducing the rotation speed to lower the water level in the basket and raise the water level in chamber to cause the unit dose package within the chamber to move upwards; and repeating the steps of increasing and reducing the rotational speed to cause the unit dose package to break open and at least partially dissolve. A laundry washing machine configured to perform this process is also provided.

13 Claims, 3 Drawing Sheets

(51) Int. Cl.
*D06F 37/36* (2006.01)
*D06F 37/40* (2006.01)
*D06F 39/08* (2006.01)

(52) U.S. Cl.
CPC ..... *D06F 39/088* (2013.01); *D06F 2204/065* (2013.01); *D06F 2204/088* (2013.01)

(58) Field of Classification Search
CPC ..... D06F 2204/065; D06F 2204/088; D06F 23/04; D06F 2105/46; D06F 2103/18; D06F 2105/04
See application file for complete search history.

(56) References Cited

U.S. PATENT DOCUMENTS

| | | | |
|---|---|---|---|
| 4,882,917 | A | 11/1989 | Mizusawa et al. |
| 5,884,506 | A | 3/1999 | Blauert et al. |
| 7,036,177 | B2 | 5/2006 | Aouad et al. |
| 7,181,934 | B2 | 2/2007 | Hsu et al. |
| 8,931,311 | B2 | 1/2015 | Leibman et al. |
| 9,271,627 | B2 | 3/2016 | Alexander et al. |
| 9,574,297 | B2 | 2/2017 | Berndsen et al. |
| 9,637,857 | B2 | 5/2017 | Del Pos et al. |
| 9,663,893 | B2 | 5/2017 | Malheiros |
| 9,850,618 | B2 | 12/2017 | Burger et al. |
| 9,903,063 | B2 | 2/2018 | Carpenter et al. |
| 9,970,148 | B2 | 5/2018 | Alexander et al. |
| 9,976,246 | B2 | 5/2018 | Malheiros |
| 10,480,113 | B2 | 11/2019 | Favaro et al. |
| 10,519,590 | B2 | 12/2019 | Malheiros |
| 10,731,284 | B2 | 8/2020 | Alexander et al. |
| 10,815,607 | B2 | 10/2020 | Costa et al. |
| 2004/0200245 | A1 | 10/2004 | Cheo et al. |
| 2005/0102767 | A1 | 5/2005 | Aouad et al. |
| 2005/0166645 | A1 | 8/2005 | Favret et al. |
| 2005/0229652 | A1 | 10/2005 | Kim et al. |
| 2005/0241072 | A1 | 11/2005 | Kim et al. |
| 2005/0274156 | A1 | 12/2005 | Yang |
| 2007/0163307 | A1 | 7/2007 | Kramme et al. |
| 2009/0119849 | A1 | 5/2009 | Hill et al. |
| 2009/0293203 | A1 | 12/2009 | Hettinger et al. |
| 2011/0247147 | A1 | 10/2011 | Amos et al. |
| 2012/0060568 | A1 | 3/2012 | Buso et al. |
| 2012/0067089 | A1 | 3/2012 | Buso et al. |
| 2012/0272691 | A1 | 11/2012 | Leibman et al. |
| 2014/0060121 | A1 | 3/2014 | Burger et al. |
| 2014/0060581 | A1 | 3/2014 | Alexander et al. |
| 2014/0060594 | A1 | 3/2014 | Alexander et al. |
| 2014/0157835 | A1 | 6/2014 | Del Pos et al. |
| 2014/0165663 | A1 | 6/2014 | Celotto et al. |
| 2015/0013075 | A1 | 1/2015 | Herrera et al. |
| 2015/0059413 | A1 | 3/2015 | Yoo et al. |
| 2015/0267340 | A1 | 9/2015 | Malheiros |
| 2015/0345069 | A1 | 12/2015 | Leibman et al. |
| 2016/0047077 | A1 | 2/2016 | Leibman et al. |
| 2016/0237612 | A1 | 8/2016 | Ghosh et al. |
| 2017/0073877 | A1 | 3/2017 | Hettinger et al. |
| 2017/0297770 | A1 | 10/2017 | Snider et al. |
| 2018/0073185 | A1 | 3/2018 | Burger et al. |
| 2018/0135226 | A1 | 5/2018 | Alexander et al. |
| 2018/0155864 | A1* | 6/2018 | Alexander ..... D06F 39/022 |
| 2019/0017208 | A1 | 1/2019 | Marangoni et al. |
| 2020/0370229 | A1 | 11/2020 | Bensel et al. |
| 2021/0025103 | A1 | 1/2021 | Li et al. |

FOREIGN PATENT DOCUMENTS

| | | | |
|---|---|---|---|
| EP | 1126070 | A1 | 8/2001 |
| EP | 2025798 | A2 | 2/2009 |
| EP | 2239363 | A1 | 10/2010 |
| EP | 2241669 | A1 | 10/2010 |
| EP | 3037582 | A1 | 6/2016 |
| EP | 3184688 | A1 | 6/2017 |
| EP | 3257998 | A1 | 12/2017 |
| EP | 3293302 | A1 | 3/2018 |
| EP | 2540902 | B1 | 5/2020 |
| EP | 3660198 | A1 | 6/2020 |
| FR | 1209601 | A | 3/1960 |
| GB | 586424 | | 3/1947 |
| GB | 589374 | | 6/1947 |
| JP | 2016073330 | A | 5/2016 |
| WO | 2005059229 | A1 | 6/2005 |
| WO | 2005061685 | A1 | 7/2005 |
| WO | 2007051988 | A1 | 5/2007 |
| WO | 2015197109 | A1 | 12/2015 |
| WO | 2016101994 | A1 | 6/2016 |
| WO | 2016102005 | A1 | 6/2016 |

OTHER PUBLICATIONS

International Search Report and Written Opinion for International Application No. PCT/EP2014/079176, dated Mar. 9, 2015, 9 pages.
International Preliminary Report on Patentability for International Application No. PCT/EP2014/079176, dated Jun. 27, 2017, 7 pages.
International Search Report and Written Opinion for International Application No. PCT/IB2019/000746, dated Jun. 25 2020, 18 pages.
International Search Report and Written Opinion for International Application No. PCT/EP2017/072466, dated Nov. 10, 2017—11 pages.
International Search Report and Written Opinion for International Application No. PCT/EP2020/068875, dated Sep. 22, 2020, 11 pages.
Notice of Allowance for U.S. Appl. No. 15/537,701, dated May 19, 2020, 9 pages.
Non Final Office Action for U.S. Appl. No. 16/131,935, dated Jan. 25, 2021, 14 pages.
Notice of Allowance for U.S. Appl. No. 16/332,116, dated Jan. 25, 2021, 8 pages.
Non Final Office Action for U.S. Appl. No. 16/131,912, dated Aug. 19, 2020, 19 pages.
Final Office Action for U.S. Appl. No. 16/131,757, dated Aug. 6, 2020, 15 pages.
International Search and Written Opinion for International Application No. PCT/EP2019/072846, dated Oct. 22, 2019, 11 pages.
International Search Report and Written Opinion for International Application No. PCT/EP2020/071064, dated Nov. 9, 2020, 14 pages.
Non Final Office Action for U.S. Appl. No. 16/131,921, dated Dec. 22, 2020, 32 pages.
Notice of Allowance for U.S. Appl. No. 16/131,912, dated Dec. 9, 2020, 17 pages.
Non Final Office Action for U.S. Appl. No. 16/131,757, dated Oct. 16, 2020, 20 pages.
Non Final Office Action for U.S. Appl. No. 16/131,757, dated Apr. 1, 2020, 17 pages.
Final Office Action for U.S. Appl. No. 16/131,935, dated Mar. 18, 2021, 21 pages.
Notice of Allowance for U.S. Appl. No. 16/131,757, dated Mar. 17, 2021, 30 pages.
Final Office Action for U.S. Appl. No. 16/131,921, dated Mar. 19, 2020, 28 pages.
Notice of Allowance for U.S. Appl. No. 16/332,116, dated Mar. 19, 2021, 23 pages.
Notice of Allowance for U.S. Appl. No. 16/131,912, dated Feb. 22, 2021, 14 pages.
Non Final Office Action for U.S. Appl. No. 16/131,921, dated Apr. 30, 2021, 16 pages.
Notice of Allowance for U.S. Appl. No. 16/131,935, dated Jun. 24, 2021, 12 pages.
Brazilian Written Opinion for Brazilian Application No. 112019003786-1, dated Jun. 23, 2021, 4 pages.

* cited by examiner

LAUNDRY WASHING MACHINE FOR USE WITH UNIT DOSE DETERGENT PACKAGES

TECHNICAL FIELD

The present invention concerns the field of laundry washing machines and fabric cleaning techniques, and particularly to machines and techniques using unit dose packages for detergent or other compositions.

BACKGROUND

The use of automated laundry washing machines is widespread. Such machines include both relatively simple laundry washing machines that can only wash and rinse laundry, and more complex laundry washing machines that can also dry laundry. The term "laundry washing machine" is used herein to refer to both types of laundry washing machine, and other laundry washing machines as may be known or later made available.

A laundry washing machine typically includes a tub configured to receive and hold the cleaning solution and a drum rotatably mounted inside the tub to receive and hold fabric laundry products, such as clothing, bed sheets and other linens, curtains, and the like. The drum is perforated or otherwise configured to allow cleaning solution to pass between the tub and the drum. In "front-loading" washing machines, the drum rotates on a horizontal or nearly horizontal axis, and the cleaning solution is provided in the lower end of the tub, and as the drum rotates, the laundry is repeatedly raised and lowered into and out of the cleaning solution. In "top-loading" washing machines, the drum rotates on a vertical or nearly vertical axis, and the cleaning solution is provided, during the wash phase, at a level at which the laundry is immersed within the solution. The drum may be reciprocated back and forth to agitate the laundry and cleaning solution, or the drum may remain still while a separate agitator located inside the drum moves to perform the agitation.

Laundry washing machines typically use a liquid solution (or "liquor") to help remove soil from fabrics. The liquid solution usually is water-based, and may comprise water alone, or water mixed with additives (e.g., detergent, fabric softener, bleach, etc.). The cleaning additives may be provided in loose or packaged forms. Loose additives typically comprise detergent or the like in a powder, liquid or gel form. Packaged additives are typically provided in unit dose packages (sometimes called a "UDP" or "pod") containing a pre-measured amount of additive. A typical UDP includes one or more additives, such as detergents, incorporated into a water-soluble pouch. The detergent may be in a powder, liquid, paste, waxy or gel form, and the pouch typically comprises a water-soluble film. In some cases, the pouch may have multiple compartments containing different compositions. Suitable pouch materials can vary, but they typically comprise polymeric materials, copolymers, or mixtures of materials that are soluble in water.

The detergent may be deposited directly into the drum, or it may be deposited into a receptacle that feeds into the drum. In the case of top-loading washing machines, a UDP is typically dropped into the drum with the laundry at the beginning of the washing process. The inventors have determined that this method can be ineffective at quickly dissolving the UDP pouch and dispersing the additive throughout the wash liquor. For example, the UDP might become tightly trapped in the laundry, leading to slow dissolution of the pouch and a high local concentration of additive that can stain or damage the laundry. Thus, there is a need to provide alternative methods for adding UDPs to washing machines, and particularly top-loading washing machines.

This description of the background is provided to assist with an understanding of the following explanations of exemplary embodiments, and is not an admission that any or all of this background information is necessarily prior art.

SUMMARY

In a first exemplary aspect, there is provided a laundry washing machine having: a housing having a lower end configured to support the housing on a support surface, an upper end opposite the lower end, and an access opening at an upper end; a door movably attached to the housing and configured to selectively open and close the access opening; a basket located in the housing and comprising a bottom wall and a sidewall extending upwards from the bottom wall to an open basket end opposite the bottom wall, the basket being mounted to the housing to be rotatable about a rotation axis extending from the lower end of the housing to the upper end of the housing; and a post located in the basket and extending along and being rotatable relative to the rotation axis. The post includes a chamber located inside the post, at least a portion of the chamber extending between a first location along the rotation axis and a second location along the rotation axis, the second location being above the first location, wherein the portion of the chamber extending between the first location and the second location is dimensioned in a direction orthogonal to the rotation axis to allow a unit dose package to move between the first location and the second location, and one or more chamber passages extending from the chamber to an internal volume of the basket. A tub surrounds the bottom wall of the basket and at least a portion of the sidewall of the basket. The laundry washing machine further includes: a water supply system having an outlet configured to direct a flow of water into the tub or the basket; a valve system configured to selectively control the flow of water through the water supply system; a motor system configured to selectively rotate at least one of the basket and the post about the rotation axis; and a controller operatively connected to the valve system and the motor system. The controller is configured to: (a) operate the valve system to supply water to fill the basket to a first basket water level, whereupon a portion of the water passes through the one or more chamber passages from the internal volume of the basket to fill the chamber to a first chamber water level, (b) operate the motor system to rotate one or both of the basket and the post about the rotation axis to cause the water in the basket to rise to a second basket water level, whereupon at least a portion of the water in the chamber passes through the one or more chamber passages to the internal volume of the basket to cause the water in the chamber to lower to a second chamber water level, and to cause a unit dose package within the chamber to move downwards towards the first location, (c) operate the motor system to stop rotating or reduce the rotation speed of one or both of the basket and the post about the rotation axis to cause the water in the basket to drop to a third basket water level, whereupon a portion of the water in the internal volume of the basket passes through the one or more chamber passages to the chamber to cause the water in the chamber to rise to a third chamber water level, and to cause the unit dose package within the chamber to move upwards towards the second location, and (d) repeat steps (b) and (c) for a predetermined duration selected to cause the unit dose package to break open and at least partially dissolve.

In some aspects, the predetermined duration can be a predetermined amount of time.

In some aspects, the predetermined duration can be a predetermined number of repetitions of steps (b) and (c).

In some aspects, the controller may be configured to operate step (a) while the motor system is not operated to rotate either the basket or the post, and the first basket water level is equal to the first chamber water level.

In some aspects, the third basket water level may be less than the first water basket level and the third chamber water level may be greater than the first chamber water level.

In some aspects, the post may be rotationally fixed to the basket.

In some aspects, post may include an impeller. The impeller may include a number of vanes extending from the post into the internal volume of the basket.

In some aspects, the post may include an access port into the chamber, and a cover configured to selectively open or close the access port.

In some aspects, the water supply system may have a first water supply passage configured to connect to a hot water main supply, and a second water supply passage configured to connect to a cold water main supply, and the valve system may have a first valve operative to control a flow of hot water through the first passage and a second valve operative to control a flow of cold water through the second passage.

In some aspects, the motor system may have a first motor operatively connected to the basket, and a second motor operatively connected to the post.

In some aspects, the motor system may have a single motor operatively connected to the basket and the post, and a clutch configured to selectively connect the motor to rotate the basket alone in a first configuration, and to connect the motor to rotate the basket and impeller together in a second configuration.

In some aspects, the one or more chamber passages may include one or more openings extending laterally though the post.

In some aspects, the one or more chamber passages may include one or more passages extending through the post to a location adjacent the bottom wall of the basket.

In some aspects, the chamber may include one or more internally-extending protrusions located between the first location and the second location.

In another exemplary aspect, there is provided a method for breaking a unit dose package located in a chamber within a post centrally located in a rotatable basket. The method includes: filling the basket with water to a first level, whereupon a portion of the water passes from the internal volume of the basket to fill the chamber to a first chamber water level; increasing a rotation speed of one or both of the basket and the post about a rotation axis to cause the water in the basket to rise to a second basket water level, whereupon at least a portion of the water in the chamber passes to the internal volume of the basket to cause the water in the chamber to lower to a second chamber water level, and to cause a unit dose package within the chamber to move downwards; reducing the rotation speed of the basket and/or post about the rotation axis to cause the water in the basket to drop to a third basket water level, whereupon a portion of the water in the internal volume of the basket passes into the chamber to cause the water in the chamber to rise to a third chamber water level, and to cause the unit dose package within the chamber to move upwards; and repeating the steps of increasing the rotational speed and reducing the rotational speed for a predetermined duration selected to cause the unit dose package to break open and at least partially dissolve.

In some aspects, increasing the rotation speed may include increasing the rotation speed from a stopped condition.

In some aspects, reducing the rotation speed may include reducing the rotation speed to a stopped condition.

In some aspects, the predetermined duration may be a predetermined length of time.

In some aspects, the predetermined duration may be a predetermined numbed of repetitions of the steps of increasing the rotation speed and reducing the rotation speed.

BRIEF DESCRIPTION OF THE DRAWINGS

Embodiments of the invention will now be described, strictly by way of example, with reference to the accompanying drawings, in which.

DESCRIPTION OF EXEMPLARY EMBODIMENTS

The exemplary embodiments described herein provide apparatus and methods for enhancing the ability of top-loading washing machines to break open, dissolve, and distribute the contents of unit dose packages ("UPDs").

Figure 1:
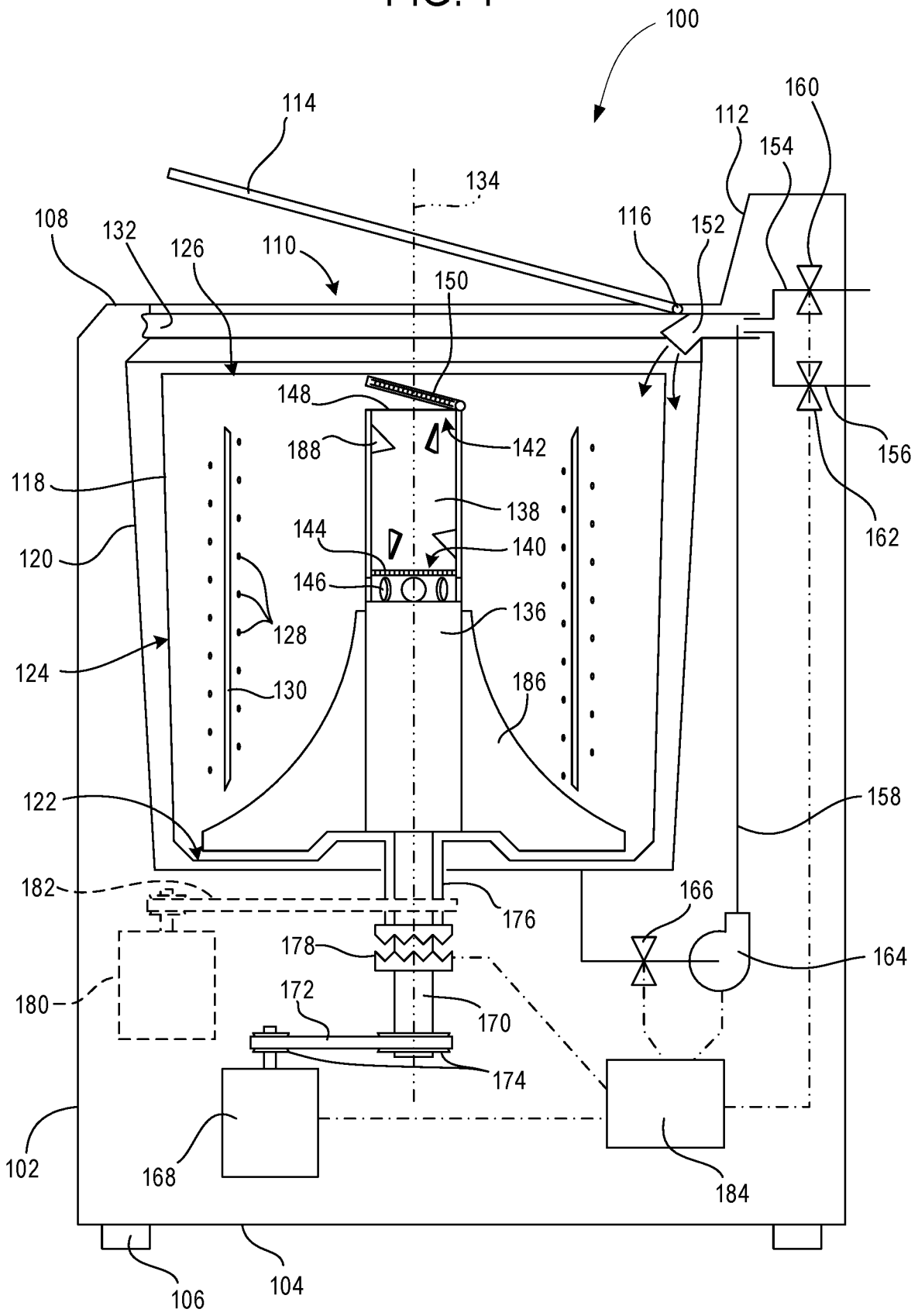
FIG. 1 schematically illustrates a first exemplary embodiment of a top-loading laundry washing machine.
Figure 2:
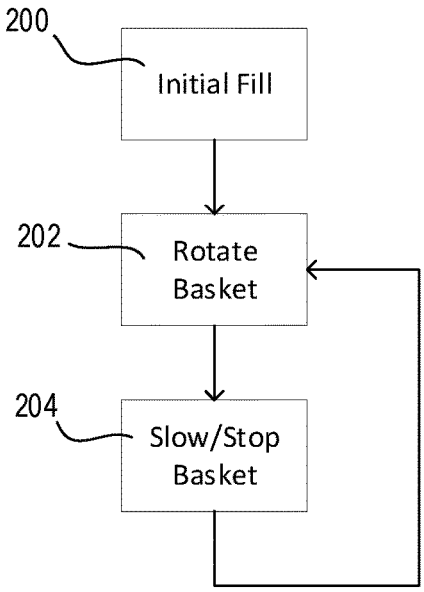
FIG. 2 schematically illustrates a method for operating a laundry washing machine.

FIG. 1 illustrates a top-loading laundry washing machine 100. The washing machine 100 includes a housing 102 having a lower end 104 that is configured to rest on a floor or other support surface via feet 106 or the like. The housing 102 extends upward to an upper end 108 that is located opposite the lower end 104. The upper end 108 includes an access opening 110, and may include a control panel 112 or the like. The access opening 110 is selectively opened and closed by a door 114, which is movably mounted on the housing 102 by a pivot 116, sliders, or the like. The door 114 may include a lock to prevent opening during operation of the machine 100, an interlock that disables the machine 100 when the door 114 is opened during operation, or other conventional safety features. The door 114 also may include a window to allow viewing into the machine 100 while the door 114 is closed.

A washing assembly is located inside the housing 102 below the access opening 110. The washing assembly generally includes a basket 118 that is mounted to rotate within a tub 120. The basket 118 has a bottom wall 122 and a generally cylindrical sidewall 124 that extends upwards from the bottom wall 122 to end at an open top basket end 126 located near the access opening 110. The basket 118 includes a plurality of openings 128 that render it water-pervious. The openings 128 may be located in one or both of the bottom wall 122 and the sidewall 124, and may comprise any suitable pattern or size as known in the art to provide movement of water in and out of the basket 118. The basket 118 also may include agitators 130 or vanes that extend into the basket's inner volume to help move the laundry during cleaning.

The tub 120 provides a generally water-impervious vessel to prevent wash water from escaping from the washing assembly. To this end, the tub 120 surrounds the bottom wall 122 of the basket 118, and extends upwards to surround some, and more preferably all, of the basket sidewall 124. A flexible seal 132 may be provided to join the top of the tub 120 to the housing 102 to prevent water from passing through this location while still allowing the washing assembly to move relative to the housing 102 during operation. The tub 120 may include one or more fluid access ports, such as drain openings and the like, as known in the art.

The basket 108 is mounted to rotate, relative to the housing 102, about a rotation axis 134. The rotation axis 134 extends in a direction from the lower housing end 102 to the upper housing end 108, and may be vertical (i.e., aligned with the local gravitational direction) or nearly vertical when the housing 102 is placed on a level supporting surface. Any suitable mounting system may be used to rotatably mount the basket 118 to the housing 102, and such system may include bearings, bushings, water seals, and the like. The basket 118 also may be laterally movable or tiltable to accommodate motion caused by offset or unbalanced laundry loads during basket spinning operations. For example, the basket 118 and tub 120 may be mounted on gimbal mount or a plurality of dampers to allow some motion relative to the housing 102. Such mounting features are well-known in the art of laundry washing machines and need not be explained in any more detail herein.

A post 136 is located inside the basket 118, and extends along the rotation axis 134. The post 136 may be rotationally fixed to the basket 118 such that it rotates about the rotation axis 134 in unison with the basket 118. Alternatively, the post 136 may be movable relative to the basket 118, such as by being rotatably mounted to the housing 102 to independently rotate about the rotation axis 134. More preferably, however, both alternatives may be provided in a single embodiment by mounting the post 136 to be selectively rotationally fixed to the basket 118 by using a clutch or the like, as discussed in more detail below.

The post 136 may be configured as the center post of an impeller having one or more impeller vanes 186 that extend into the internal volume of the basket 118, but this is not strictly required. In another embodiment, a separate impeller having impeller vanes may be provided to surround and move independently of the post 136. Other alternatives and variations will be apparent to persons of ordinary skill in the art in view of the present disclosure.

Inside the post 136 is a chamber 138. The chamber 138 extends within the post 136 along the rotation axis 134. At least a portion of the chamber 138 is dimensioned in a direction orthogonal to the rotation axis 134 to allow a unit dose package to move vertically along that portion of the chamber. For example, a portion of the chamber 138 may extend from a first (lower) location 140 along the rotation axis 134 to a second (upper) location 142 along the rotation axis 134, with a width W of the chamber being wider than a unit dose package intended to be used in the machine 100. Typical unit dose packages vary in size, but generally are no more than 1.5 to 2 inches along the longest dimension. The chamber 138 also may be dimensioned in the direction orthogonal to the rotation axis 134 to hold multiple unit dose packages. Portions of the chamber 138 also may extend below and above the first location 140 and the second location, respectively 142. For example, the chamber 138 may include a region below the first location 140 that is too narrow to allow the unit dose package to pass through, or that is obstructed by a grate 144 or mesh that is intended to prevent passage of the unit dose package.

The chamber 138 and the interior volume of the basket 118 are in fluid communication with each other to allow water to pass between the two. For example, as shown in FIG. 1, one or more chamber passages 146 extend laterally from the chamber 138 to an internal volume of the basket. One or more, and preferably all, of the chamber passages 146 are configured, along with the post 136, to allow water to flow into and out of the chamber 138 without flowing through the chamber 138 at the upper second location 142. For example, the post 136 preferably terminates at an upper opening 148 that is located above the highest normal operating level of the water in the drum 118, while the one or more chamber passages 146 are located near, at or below the first location 140. In this configuration, with the exception of additional splashing, water can only enter the chamber 138 by passing upwards from the first location 140. Similarly, the water can only exit the chamber 138 by flowing down past the first location 140.

As noted above, a grate 144 may be provided in the chamber 138 to prevent the unit dose package from blocking or passing through the chamber passages 146 until it is mostly or entirely dissolved. The chamber 138 also may include internal structures, such as protrusions 188 that extend into the chamber 138 to assist with rupturing a unit dose package located in the chamber 138. The shown protrusion 188 have sharp tips and edges, but this is not strictly required.

The upper opening 148 of the post 136 may be configured as an access port to allow a user to insert a unit dose package into the chamber 138. The upper opening 148 may be open at all times, or it may be selectively closable by a lid 150. The lid 150 may be air permeable (e.g., include a grate or holes) and/or the upper end of the chamber 138 may include air vents, to prevent pressure from building in the chamber 138 as water moves in and out. The lid 150 also may comprise a portion of the door 114 (e.g., a protrusion that extends down from the door 114) that is located immediately above the upper opening 148 when the door 114 is closed. It will also be appreciated that the upper opening 148 may be replaced by any other suitable access port (e.g., an opening on the side of the post 136), which may have any suitable openable cover, if desired.

The washing machine 100 also includes a water supply system that is configured to fill the basket 118 to one or more operating water levels. For example, the water supply system may include a water outlet 152 that is oriented to direct water into the basket 118, into the tub 120, or into both (such as shown by the two arrows). The supplied water is free to pass between the basket 118 and the tub 120 by flowing through the openings 128 through the tub sidewall 124 and/or bottom wall 122, and therefore it is not strictly required to locate the water outlet 152 at a particular location.

Water is provided to the water outlet 152 by one or more fluid lines. Such fluid lines may include, for example, a cold water supply line 154, a hot water supply line 156, and a pump supply line 158. The cold water supply line 154 and hot water supply line 156 are connected to residential or commercial cold and hot water taps (i.e., water mains), from which they receive pressurized cold and hot water, respectively. Respective valves 160, 162 may be provided to control the flow of water from the taps to the water outlet 152, as known in the art. For example, the valves 160, 162 may be solenoid-controlled valves or the like. The operation of the valves 160, 162 is discussed in more detail below. The pump supply line 158 is connected to a water pump 164 that is, in turn, connected to a sump region of the tub 120 to withdraw washing fluid from the tub 120. The pump 164 may be selectively operated to direct washing liquid from the tub 120 to the top of the basket 118 or to otherwise recirculate the liquid in the basket 118 and tub 120. However, as indicated above, the water outlet 152 need not be located at the top of the basket 118. Another valve 166 may be provided to close flow to the pump 164 when it is not in use. Other pumps and valves also may be provided to evacuate or drain the basket 118 and tub 120 periodically during operation of the washing machine 100, as known in the art.

The washing machine 100 also includes a motor system that is configured to rotate one or both of the basket 118 and the post 136 about the rotation axis 134. For example, an electric motor 168 may be operatively connected to a post drive shaft 170 by a belt 172 and associated pulleys 174. The post drive shaft 170 is operatively connected to drive the post 136 upon rotation of the motor 168. A basket drive shaft 176 is also provided and operatively connected to drive the basket 118. A clutch 178 is operatively connected between the post drive shaft 170 and the basket drive shaft 176, and operable to selectively lock the basket drive shaft 176 to rotate in unison with the post drive shaft 170. In this embodiment, the motor 168 is always drivingly connected to the post 136, but is selectively drivingly connected to the basket 118 via the clutch 178. The clutch 178 may comprise any suitable power interruption mechanism. One example of a clutch is described in U.S. Pat. No. 9,574,297, which is incorporated herein by reference. Other alternatives and variations will be apparent to persons of ordinary skill in the art in view of the present disclosure.

If desired, the post 136 and basket 118 may include separate drive motors. For example, the clutch 178 may be omitted, and a second motor 180 may be connected to drive the basket drive shaft 176 by a second belt 182. It will be appreciated that the post drive shaft 170, basket drive shaft 176 and clutch 178 may include any variety of interconnected parts, and may include features such as speed changing gears, offset drive assemblies, and so on. The particular details of the drive mechanism and clutch (if used) are not relevant to the claimed invention, and need not be described in any more detail herein.

The washing machine 100 also includes a controller 184 that is configured to operate the various controllable parts of the machine. In particular, the controller 184 is configured to operate the valve system to selectively add water to the basket 118, and to operate the motor system to selectively rotate the basket 118 and/or post 136. Details of exemplary controllers 184 are discussed below.

FIGS. 2 and 3A-3C illustrate an exemplary method for operating the washing machine 100. In step 200, the controller 184 performs an initial fill process by activating one or both of the water tap valves 160, 162. When the valve(s) open, water passes through the water outlet 152 and into the basket 118 (directly and/or by passing through the tub 120). The controller 184 stops supplying water when the water reaches a first basket water level $B_1$. The washing machine 10 may use any suitable feedback or feedforward system to determine that the water has reached the first basket water level $B_1$. For example, in a feedback system, the water level may be estimated using a pressure sensor that detects a water pressure corresponding to the desired fill level. In a feed forward system, the valve 160, 162 may be operated for a predetermined amount of time that is expected to achieve the desired water level. Other alternatives and variations will be apparent to persons of ordinary skill in the art in view of the present disclosure.

Figure 3A:
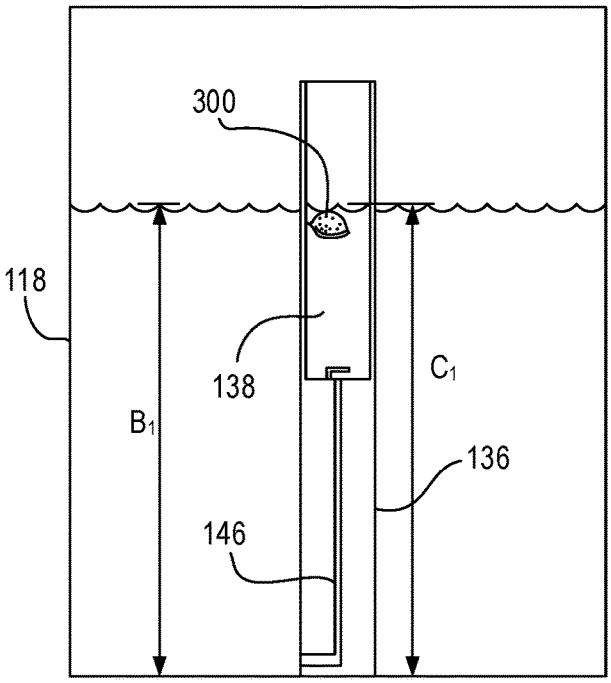
FIGS. 3A-3C schematically illustrate a second exemplary embodiment of a top-loading washing machine shown in three operatives states.

During step 200, a portion of the water in the internal volume of the basket passes through the one or more chamber passages 146 and into the chamber 138. To this end, the chamber passages 146 and at least a portion of the chamber 138 are located below the first basket water level $B_1$. Upon completing step 200, the chamber 138 is filled to a first chamber water level $C_1$. If step 200 is performed without rotating the basket 118 or the post 136, the first basket water level $B_1$ will be approximately equal to the first chamber water level $C_1$ when measured from a common point of reference, such as the bottom wall 122 of the basket 118. This is illustrated in FIG. 3A. If the basket 118 or post 136 is rotated during step 200, the first chamber water level $C_1$ may be below the first basket water level $B_1$.

Figure 3B:
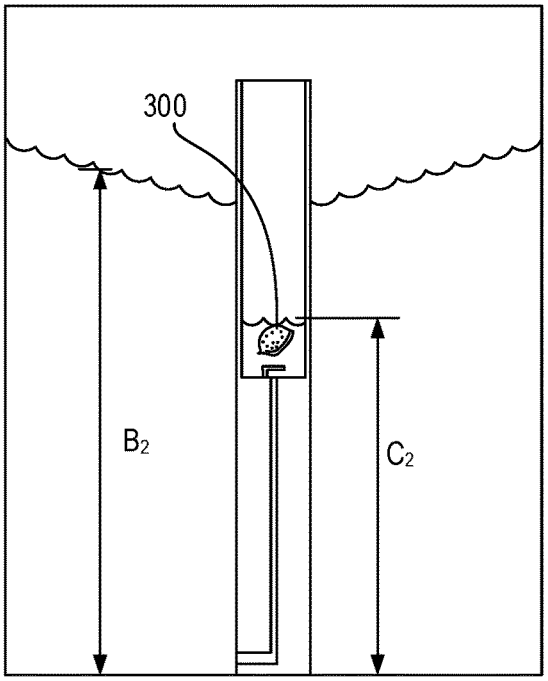

Next, in step 202, the controller 184 operates the motor system to rotate one or both of the basket 118 and the post 136 about the rotation axis 134. Such rotation causes the entire mass of water in the basket 118 and chamber 138 to move radially outwards towards the outer perimeter of the basket 118, due to centripetal force applied to the water mass. This causes the water level in the basket 118 to rise to a second basket water level $B_2$. At the same time some of all of the water in the chamber 138 flows back out through the chamber passages 146 to reduce the water in the chamber 138 to a second chamber water level $C_2$ that is lower than the first chamber water level $C_1$. Thus, a unit dose package 300 located in the chamber 138 will move down with the water towards the lower end of the chamber 138. Step 202 is illustrated in FIG. 3B.

Next, in step 204, the controller 184 operates the motor system to either stop or reduce the rotation speed of the basket 118 and/or post 136. Upon doing so, the centripetal force is essentially terminated (except for some that might linger as a result of the momentum of the water), and gravity takes over to pull the water in the basket 118 down to a third basket water level $B_3$. This causes water to pass through the chamber passages 146 from the internal volume of the basket 118 and into the chamber 138, and raises the water level in the chamber 138 to a third chamber water level $C_3$. Thus, the unit dose package 300 moves upwards with the water towards the upper end of the chamber 138.

Figure 3C:
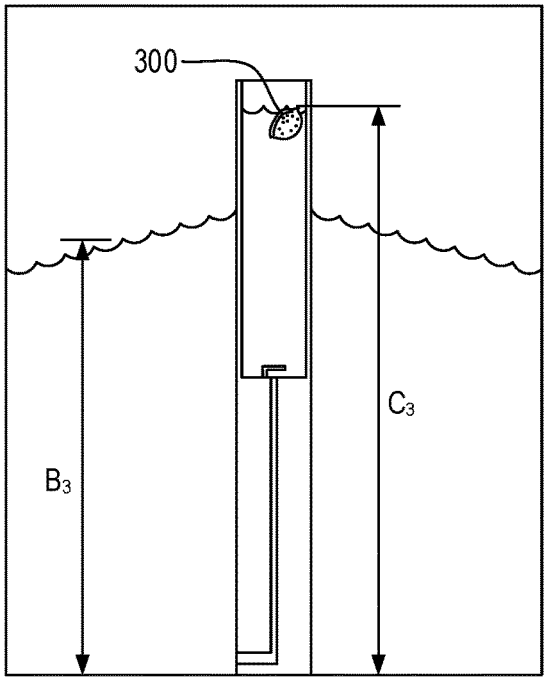

It will be understood that the third basket water level $B_3$ may be equal to the first basket water level $B_1$, but this is not strictly necessary. For example, if the first basket water level $B_1$ is measured with the basket 118 and post 136 being held still, but the basket 118 and post 136 are not fully stopped in step 204, then the third basket water level $B_3$ might be higher than the first basket water level $B_1$. For the same reasons, the third chamber water level $C_3$ need not be the same as the first chamber water level $C_1$, and may be lower than the first chamber water level $C_1$. It is also expected that, in some embodiments, or in some transient operating conditions, the third basket water level $B_3$ might be lower than the first basket water level $B_1$, and the third chamber water level $C_3$ may be higher than that first chamber water level $C_1$. This might occur as water sloshes back towards the post 136 and overfills into the chamber 138, such as shown in FIG. 3C. It will further be understood that the third basket water level $B_3$ and the third chamber water level $C_3$ may vary due to turbulence in the water. In any event, however, the third basket water level $B_3$ will generally (i.e., except in unusual transient operating conditions) be less than the second basket water level $B_2$, and the third chamber water level $C_3$ will be greater than the second chamber water level $C_2$.

Upon completing step 204, the process then preferably repeats by returning to step 202 to again rotate the basket 118. The rotation direction may change during each successive return to step 202, thus performing a back and forth circulation within the basket 118. Alternatively, the process may comprise speed pulses, in which the rotation speed increases and decreases without changing direction. It is also not strictly necessary to stop the rotation in step 204, and step 200 may be conducted while rotating the basket 118 and/or post 136.

The foregoing process uses variations in the hydraulic pressure of the water within the internal volume of the basket 118 to lower and raise the water level within the chamber 138. During such action, the unit dose package 300 is subjected to mechanical and hydraulic forces that encourage dissolution and tearing of the pouch, and mixing of the contents with the wash water. The process may be activated for any duration to enhance the breaking or dissolution of the unit dose package. For example, the steps 202 and 204 may be repeated for a predetermined amount of time, or for a predetermined number of repetitions of the steps. The process can also be modified by increasing or decreasing the rapidity with which the cycle transitions between steps 202 and 204, to provide more or less intense up and down breaking motion to the unit dose package 300. The duration may be fixed for all wash cycles, or it may be variable depending on other wash conditions. For example, when the wash is being performed using only cold water, the duration may be increased to help encourage breaking and dissolution of the unit dose package. Other alternatives and variations will be apparent to persons of ordinary skill in the art in view of the present disclosure.

It will be understood that the surface of the water at any given time will generally include variations caused by local accumulations of laundry or water currents causing waves and the like. Furthermore, during at least step 202, the surface of the water in both the basket 118 and the chamber 138 will be inclined due to the centripetal force moving the water radially outward. Such effects might cause some portion of the water in the basket 118 to actually be below the first basket water level $B_1$, but the average water level will nevertheless increase in step 202 to be greater than the first basket water level $B_1$. Thus, the term "water level" is used herein to the average height of the water relative to the rotation axis 134 in the respective portion of the washing machine 100.

FIGS. 3A-3C also show variations on the construction shown in FIG. 1. For example, the post 136 lacks impeller features. Also, the chamber passage 146 comprises one or more passages that extend through the post 136 to fluidly connect with the internal volume of the basket 118 at a location adjacent the bottom wall 122 of the basket 118. Also, the grate 144 is removed, and replaced by a vented cap 302 that covers the chamber passage to prevent the unit dose package 300 from occluding the chamber passage 146. Other alternatives and variations will be apparent to persons of ordinary skill in the art in view of the present disclosure.

Figure 4:
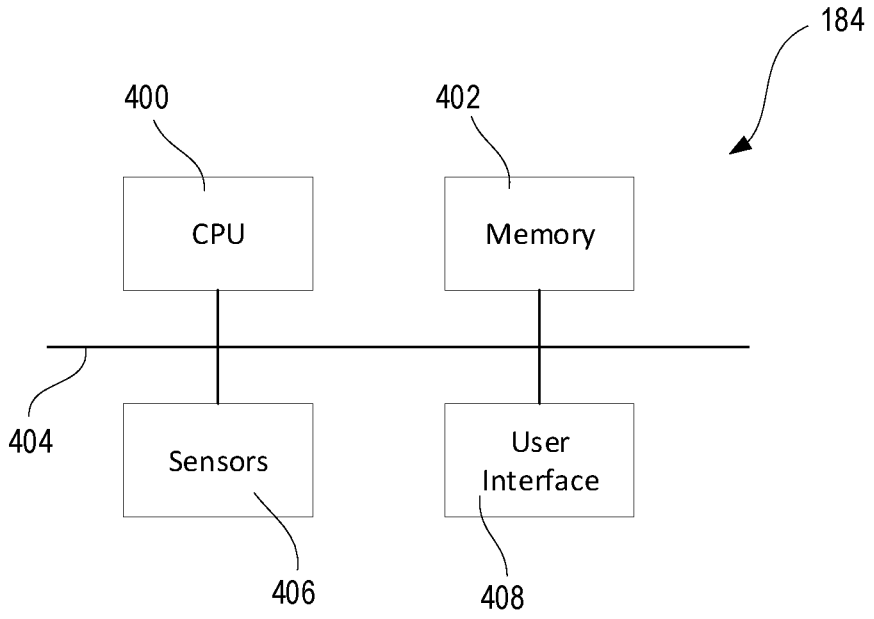
FIG. 4 schematically illustrates an exemplary control system for a laundry washing machine.

Referring now to FIG. 4, the controller 184 may include hardware and software configured to operate the laundry washing machine 100 and to perform the operations and methods described herein. In one example, the controller 184 includes one or more processors that are programmed to execute machine-readable code stored on one or more memory devices. A typical processor may be a central processing unit (CPU) 400 including a microprocessor, an application-specific integrated circuit (ASIC), and so on. Memory 402 may be provided as random access memory (RAM) for temporary data storage, read only memory (ROM) for permanent data storage, firmware, flash memory, external and internal hard-disk drives, and the like. The CPU 400 communicates with the memory 402 via a communication bus 404 or the like to read and execute computer-readable instructions and code stored in a non-transient manner in the memory 402. The controller 184 also may be connected to one or more sensors 406, such as water level sensors, temperature sensors, and the like. The controller 184 also may incorporate one or more wired or wireless communication ports, such as serial busses, TCP/IP ports, Bluetooth transceivers, NFC transceivers, wi-fi transceivers and so on.

The operative connections between the controller 184 and the remaining parts (shown schematically by dashed lines) may be by electrical wires, wireless communication, and the like. In the shown example, wired communication is used by connecting the various controlled parts to the communications bus 404. Suitable control devices (e.g., solenoids to operate valves, motor controllers, etc.) are provided to allow the controller 184 to operate the various components. Conventional fuses, power converters, and other ancillary features also may be included as necessary or desired.

The controller 184 is also may be operatively connected to or include a user interface 408, such as a control panel 112, that is accessible to the user. The user interface 408 is configured to allow the user to select and set the washing parameters, for example by selecting a desired washing program. The user interface 408 also may be configured to allow the user to select a unit dose package operating mode, in which the foregoing methods for breaking and at least partially dissolving the unit dose package will be implemented during operation of the cleaning program. In other cases, the selection of this mode may be performed automatically according to the selection of particular operating modes, used in all operating conditions, or performed according to other criteria.

The present disclosure describes a number of inventive features and/or combinations of features that may be used alone or in combination with each other or in combination with other technologies. The embodiments described herein are all exemplary, and are not intended to limit the scope of the claims. It will also be appreciated that the inventions described herein can be modified and adapted in various ways, and all such modifications and adaptations are intended to be included in the scope of this invention.

The invention claimed is:

1. A method for breaking a unit dose package located in a chamber within a post centrally located in a rotatable basket of a laundry washing machine, the method comprising:

filling the basket with water to a first basket water level, whereupon a first portion of the water passes from the internal volume of the basket to fill the chamber to a first chamber water level;

increasing a rotation speed of one or both of the basket and the post about a rotation axis to cause the water in the basket to rise to a second basket water level, whereupon a second portion of the water in the chamber passes to the internal volume of the basket to cause the water in the chamber to lower to a second chamber water level, and to cause the unit dose package within the chamber to move downwards;

reducing the rotation speed of the basket and/or the post about the rotation axis to cause the water in the basket to drop to a third basket water level, whereupon a third portion of the water in the internal volume of the basket passes into the chamber to cause the water in the chamber to rise to a third chamber water level, and to cause the unit dose package within the chamber to move upwards;

repeating the steps of increasing the rotation speed and reducing the rotation speed for a predetermined duration selected to cause the unit dose package to break open and at least partially dissolve; and venting air in the chamber to prevent changes in air pressure within the chamber during the steps of increasing the rotation speed and reducing the rotation speed.

2. The method of claim 1, wherein increasing the rotation speed comprises increasing the rotation speed from a stopped condition.

3. The method of claim 1, wherein reducing the rotation speed comprises reducing the rotation speed to a stopped condition.

4. The method of claim 1, wherein the predetermined duration comprises a predetermined length of time.

5. The method of claim 1, wherein the predetermined duration comprises a predetermined number of repetitions of the steps of increasing the rotation speed and reducing the rotation speed.

6. The method of claim 1, wherein the third basket water level is less than the first basket water level and the third chamber water level is greater than the first chamber water level.

7. The method of claim 1, further comprising receiving the unit dose package in the chamber through an opening at an upper end of the chamber.

8. The method of claim 7, wherein a lower end of the chamber comprises one or more openings extending laterally through the post, and the method further comprises supporting the unit dose package above the one or more openings before the first portion of the water passes from the internal volume of the basket to fill the chamber to the first chamber water level.

9. The method of claim 1, wherein a lower end of the chamber comprises one or more openings extending laterally through the post, and wherein the first portion of the water, the second portion of the water, and the third portion of the water pass through the one or more openings extending laterally through the post.

10. The method of claim 9, wherein the one or more openings open to the basket at a location adjacent to a bottom wall of the basket.

11. The method of claim 1, further comprising contacting the unit dose package with one or more protrusions located within the chamber.

12. The method of claim 1, wherein the chamber comprises at least one of a top that is open during operation of the method and an air permeable lid.

13. The method of claim 1, wherein the third chamber water level is greater than the third basket water level.

* * * * *